US007243452B2

(12) United States Patent
Zeh

(10) Patent No.: US 7,243,452 B2
(45) Date of Patent: Jul. 17, 2007

(54) SMALL ARM FIRING MECHANISM

(75) Inventor: Meinrad Zeh, Weitnau (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 11/294,649

(22) Filed: Dec. 5, 2005

(65) Prior Publication Data

US 2006/0123685 A1 Jun. 15, 2006

(30) Foreign Application Priority Data

Dec. 8, 2004 (DE) ..... 10 2004 058 986

(51) Int. Cl.
*F41A 19/16* (2006.01)

(52) U.S. Cl. ..... 42/69.01; 42/69.02

(58) Field of Classification Search ..... 42/69.01, 42/69.02, 69.03; 89/136, 27.11
See application file for complete search history.

(56) References Cited

U.S. PATENT DOCUMENTS

| | | | | | |
|---|---|---|---|---|---|
| 22,881 | A * | 2/1859 | Lowe | 42/69.01 |
| 949,466 | A * | 2/1910 | Frommer | 42/106 |
| 2,249,231 | A * | 7/1941 | Smith | 42/69.02 |
| 2,249,232 | A * | 7/1941 | Smith | 42/69.02 |
| 2,775,836 | A * | 1/1957 | Emerson | 42/69.02 |
| 3,011,282 | A * | 12/1961 | Sefried, II | 42/69.03 |
| 3,707,796 | A * | 1/1973 | Bielfeldt | 42/70.05 |
| 4,152,856 | A * | 5/1979 | Tollinger et al. | 42/69.01 |
| 4,744,166 | A * | 5/1988 | Mattarelli | 42/69.01 |
| 5,363,581 | A * | 11/1994 | Blenk et al. | 42/69.02 |
| 5,386,659 | A * | 2/1995 | Vaid et al. | 42/69.02 |
| 5,487,233 | A * | 1/1996 | Jewell | 42/69.01 |
| 5,852,891 | A * | 12/1998 | Onishi et al. | 42/69.01 |
| 5,924,231 | A * | 7/1999 | Kidd | 42/69.03 |
| 7,051,638 | B2 * | 5/2006 | Thomele | 89/147 |
| 2006/0150466 | A1 * | 7/2006 | Hochstrate et al. | 42/69.03 |

FOREIGN PATENT DOCUMENTS

| | | | |
|---|---|---|---|
| DE | 9310821 U | 10/1993 | |

* cited by examiner

*Primary Examiner*—Troy Chambers
*Assistant Examiner*—Stewart T. Knox
(74) *Attorney, Agent, or Firm*—Martin Fleit; Paul D. Bianco; Fleit Kain Gibbons Gutman Bongini & Bianco P.L.

(57) ABSTRACT

The invention pertains to a firing mechanism for a small arm, particularly a rifle, with a trigger (2) that can be pivoted about a trigger axis (12), with a trigger rod (4) that is displaceably arranged within a housing (1) and serves for respectively retaining and releasing a prestressed firing pin (6), and with an articulated lever (3) that is arranged within the housing (1) such that it can be pivoted about a pivot axis (20) and is connected in an articulated fashion to the trigger rod (4), with said articulated lever being connected to the trigger (2) via the trigger rod (4). The resistance of the trigger can be easily changed without requiring significant constructive modifications if the articulated lever (3) that is connected in an articulated fashion to the trigger rod (4) has an upwardly protruding catch (22) that engages into a lower latching groove (19) on the trigger (2) in a cocked position of the firing mechanism, with the latching groove (19) being provided with an oblique stopping face (33) for a front edge (34) of the catch (22).

7 Claims, 5 Drawing Sheets

SMALL ARM FIRING MECHANISM

FIELD OF THE INVENTION

The invention pertains to a firing mechanism for a small arm, particularly a rifle, with a trigger that can be pivoted about a trigger axis.

BACKGROUND OF THE INVENTION

In classic latch-type firing mechanisms, the firing lever is provided with a latch element that engages with a complementary latch element of a trigger plate in the cocked position. When a shot is fired with such a latch-type firing mechanism, the latch elements are disengaged and the trigger elements are separated from one another. This means that another spring needs to be provided in addition to the trigger spring in order to cock the firing mechanism anew. This additional spring presses the trigger lever and the firing sear back into their engaged starting position. Under extreme conditions such as, for example, significant soiling, gumming or icing, it may occur, however, that individual elements of the firing mechanism are not returned to their starting positions after a shot is fired. This prevents the breech lock from being cocked anew and therefore makes it impossible to fire another shot. Under the aforementioned extreme conditions, there is also a certain risk of the firing sear of conventional latch-type firing mechanisms remaining in its position and not releasing the firing pin after a shot is fired.

In a firing mechanism known from DE 93 10 821 U, these problems are prevented by coupling the trigger elements to one another with the aid of a toggle link mechanism. This is achieved by providing a link that is coupled to the trigger plate on one side and to a first lever arm of an articulated lever that is pivotable about a fulcrum pin on the other side. The second lever arm of the articulated lever is connected in an articulated fashion to the lower end of a trigger rod that can be moved in the axial direction. This resulted in an engagement-free forcible connection between the trigger and the trigger rod that also made it possible to manually reset the firing mechanism. However, the resistance of the trigger cannot be easily adjusted in such a firing mechanism.

The invention is based on the objective of developing a firing mechanism of the initially described type that also makes it possible to easily change the resistance of the trigger without requiring significant constructive modifications.

This objective is attained with a firing mechanism as set forth herein. Practical embodiments and advantageous additional developments of the invention are characterized in the dependent claims.

SUMMARY OF THE INVENTION

In the firing mechanism according to the invention, the trigger and the trigger rod are not connected to one another by articulated elements that are coupled to one another in a compulsory fashion, but rather by an articulated lever that is provided with a catch and a corresponding latching element on the trigger. The latching groove has an oblique contact surface for a front edge of the catch. One significant advantage of this firing mechanism can be seen in that the resistance of the trigger can be adjusted in a relatively simple fashion by changing the contact ratios between the latching groove and the catch. In other words, it is required neither to perform significant constructive modifications nor to replace any springs.

In a constructively simple and practical embodiment, the resistance of the trigger can be adjusted by changing the angle of inclination of the oblique contact surface.

In another advantageous embodiment, the trigger has a control surface that is arranged in front of the latching groove and is contacted by the catch when the trigger is actuated. This control surface makes it possible to manually reset the firing mechanism in case the trigger or the trigger rod fails to automatically return into its starting position, e.g., due to gumming or icing.

The latching groove is preferably arranged on a latch part that can be detachably mounted on the trigger plate. This makes it possible to easily replace the latch part, if so required. In addition, the trigger can optionally be manufactured of different materials. However, the latch part and the trigger may also be realized in one piece.

BRIEF DESCRIPTION OF THE DRAWINGS

Other peculiarities and advantages of the invention are discussed in the following description of a preferred embodiment that refers to the figures. The figures show.

DETAILED DESCRIPTION OF THE INVENTION

Figure 1:
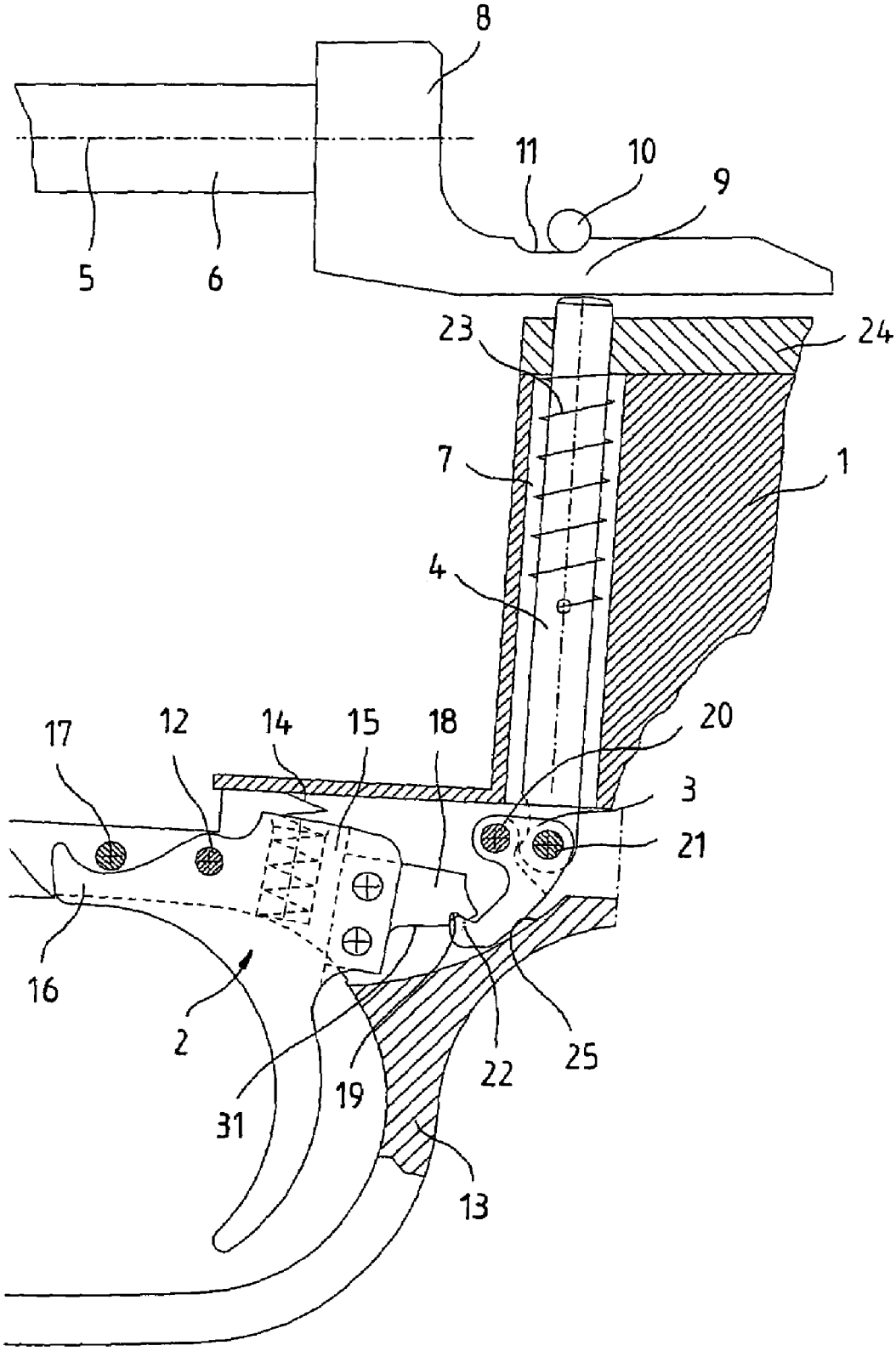
FIG. 1, a longitudinal section through a firing mechanism in a cocked initial position.
Figure 2:
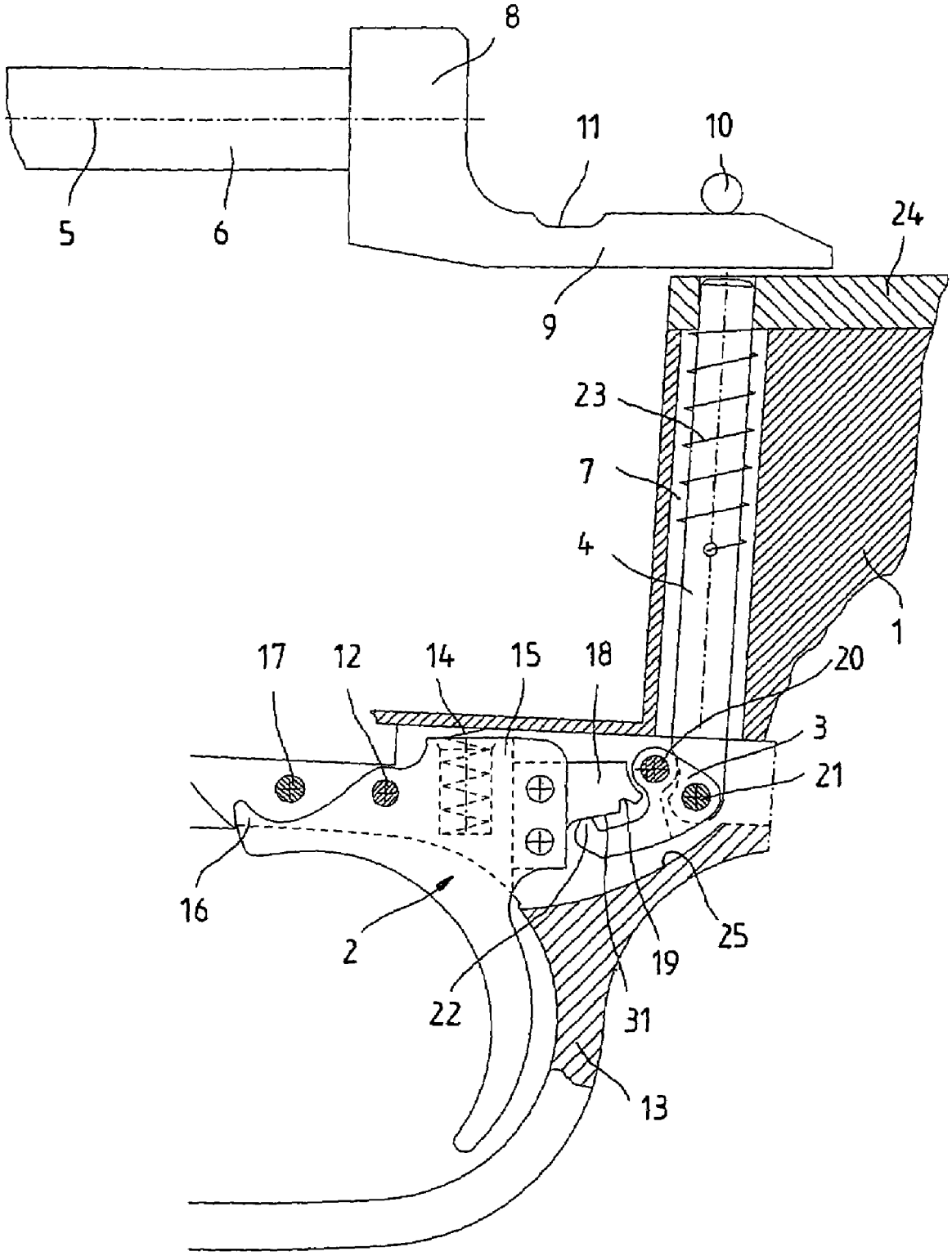
FIG. 2, a longitudinal section through the firing mechanism according to FIG. 1 in a released position.

The firing mechanism that is illustrated in two different positions in FIGS. 1 and 2 comprises a pivoted trigger 2 that is arranged in a housing 1 and is connected to a trigger rod 4 that can be displaced within the housing 1 by means of an articulated lever 3. The trigger rod 4 is guided in a corresponding bore 7 of the housing 1 such that it can be displaced transverse to the longitudinal axis 5 of a firing pin 6. The firing pin 6 is only partially illustrated in the figure, and comprises a cocking piece 8 with a rearwardly projecting web 9 on its rear end. The trigger rod 4 presses this web upward against a stationary transverse pin 10. The upper side of the web 9 is provided with a depression 11 that serves for accommodating the stationary transverse pin 10 in order to retain the firing pin 6 in a cocked rear position.

The trigger 2 is pivotably mounted in the housing 1 about a trigger axis 12, and is surrounded by the trigger guard 13. A trigger spring 14 presses the trigger 2 into a front starting position. The trigger 2 comprises a trigger plate 15 and a catch 16 that projects forward relative to the trigger axis 12 and is in contact with a safety pin 17 in the front starting position of the trigger 2 shown in FIG. 1. The safety pin 17 restricts the forward pivoting movement of the trigger 2. A rearwardly projecting latch part 18 with a latching groove 19 is mounted on the rear side of the trigger plate 15. In the embodiment shown, the latch part 18 is replaceably fixed on the trigger plate 15, e.g., with the aid of pins. The trigger 2 is made of plastic and the latch part 18 consists of metal. However, the latch part 18 and the trigger 2 may also be realized in one piece.

The articulated lever 3 is pivotable about the transverse pin 20 mounted in the housing 1, and its rear lever arm that projects rearward relative to the transverse pin 20 is connected in an articulated fashion to the lower end of the trigger rod 4 with the aid of a link pin 21. The articulated lever 3 is coupled to the trigger rod 4 in such a way that the trigger rod 4 is displaced upward or downward in the direction of its longitudinal axis when the articulated lever 3 is pivoted about the transverse pin 20. The front lever arm of the articulated lever 3 that projects forward relative to the transverse pin 20 is realized similar to a duck bill, with an upwardly projecting catch 22 that serves to engage with the latch part 18 of the trigger 2. The catch 22 of the articulated lever 3 adjoins the underside of the latch part 18 and is pressed against the underside of the latch part 18 by a compression spring 23 arranged around the trigger rod 4. The upper end of the compression spring 23 is braced against the underside of a plate 24 connected to the housing 1. The lower end of the compression spring 23 is connected to the trigger rod 4. The compression spring 23 ensures that the catch 22 is always pressed against the underside of the latch part 18. The trigger guard 13 is provided with an upper contact surface 25 that restricts the downward pivoting movement of the articulated lever 3.

Figure 3:
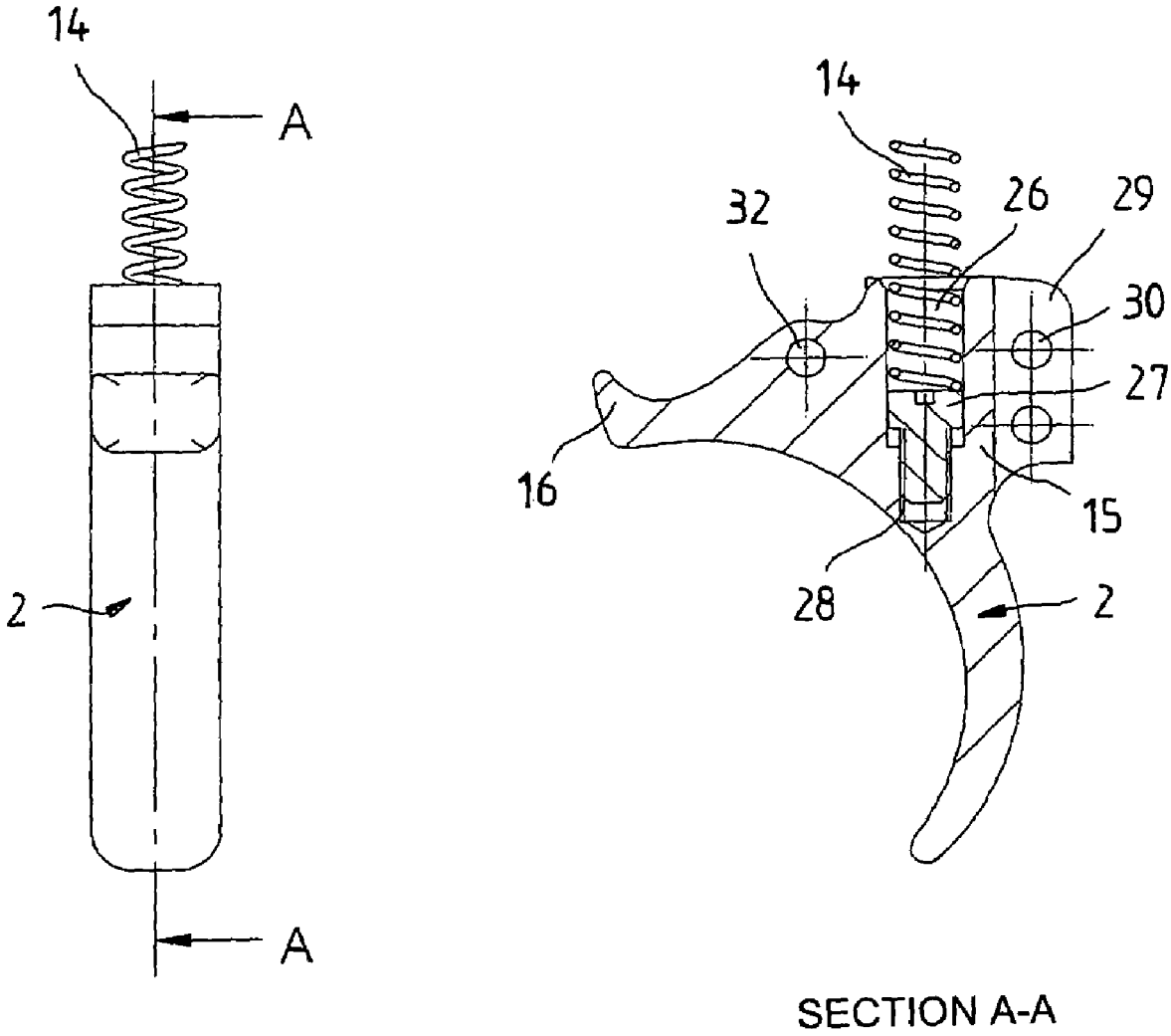
FIG. 3, an enlarged trigger seen in a front view, and a section along the line A-A.

FIG. 3 shows an enlarged trigger 2 without a latch part 22 in the form of a front view and a section. On its upper side, the trigger 2 is provided with a receptacle bore 26 in which the lower end of the trigger spring 14 is accommodated. The trigger spring 14 rests on the head of a set screw 27, the height of which can be adjusted in connection with a threaded bore 28 in the base of the receptacle bore 26. This makes it possible to precisely adjust the spring force of the trigger spring 14. A channel 29 with two bores 30 for mounting the latch part 18 shown in FIG. 1 is provided on the rear side of the trigger plate 15. The trigger 2 also contains a transverse bore 32 for accommodating the trigger axis 12.

The function of the above-described firing mechanism is discussed below with reference to FIG. 1.

In the cocked position shown in FIG. 1, the firing pin 6 with the cocking piece 8 is displaced into a rear position against the force of a not-shown main spring. The trigger 2 is in a front starting position, in which the trigger rod 4 is held in an upper locking position by the rear latch part 18 of the trigger 2 and the articulated lever 3. In this locking position, the firing pin 6 and the cocking piece 8 are held in the rear cocked position by the trigger rod 4 that projects upward relative to the plate 24 and the transverse pin 10 that engages in the depression 11 of the cocking piece 8. In the cocked position shown, the catch 22 of the articulated lever 3 engages in the latching groove 19 on the rear latch part 18 of the trigger 2 such that the firing mechanism is locked in a shock-resistant fashion.

When the trigger 2 is actuated, the rear latch part 18 is pivoted upward as shown in FIG. 2. This causes the latching groove 19 to release the catch 22 of the articulated lever 3 such that the trigger rod 4 is able to move into a lower release position in which the cocking piece 8 is released, under the influence of the main spring that acts upon the trigger rod in the downward direction. In the release position of the trigger rod, the catch 22 of the articulated lever 3 abuts a lower control surface 31 of the latch part 18 that lies in front of the latching groove 19, and is pressed against this control surface by the compression spring 23.

After the firing mechanism is released and cocked anew, the trigger 2 is pivoted back into its front starting position by the trigger spring 14 such that the catch 22 of the articulated lever 3 once again moves downward and engages in the latching groove 19. The trigger rod 4 is also displaced upward again during this process. The firing mechanism can be manually reset even if the trigger 2 or the trigger rod 4 fails to return automatically to its starting position, e.g., due to gumming or icing. The trigger 2 can be manually moved into its front starting position. This also causes the trigger rod 4 to be pressed upward via the articulated lever 3. During this process, the catch 22 initially slides along the lower control surface 31 and subsequently engages in the latching groove 19.

Figure 4:
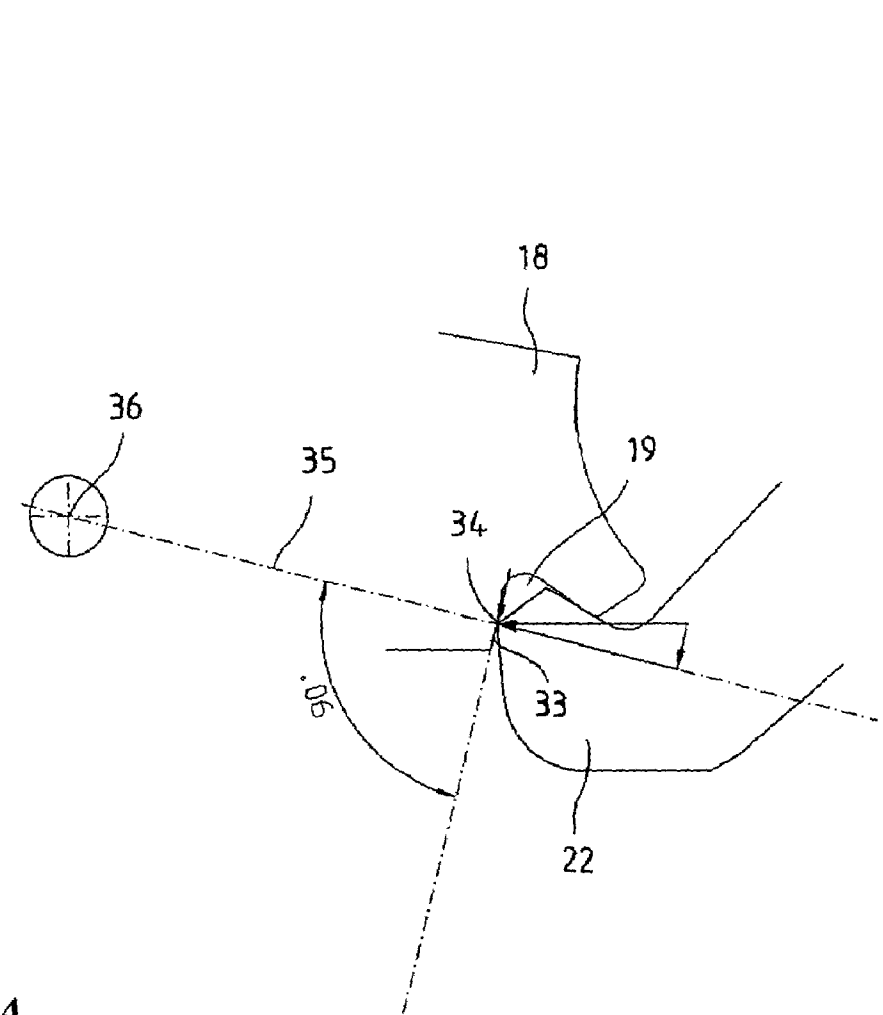
FIG. 4, a longitudinal section through a first trigger variation with low trigger weight, and an enlarged representation of the area of engagement between the catch and the latching groove, and FIG. 5, a longitudinal section through a second trigger variation with higher trigger weight and an enlarged representation of the area of engagement between the catch and the latching groove.
Figure 4:
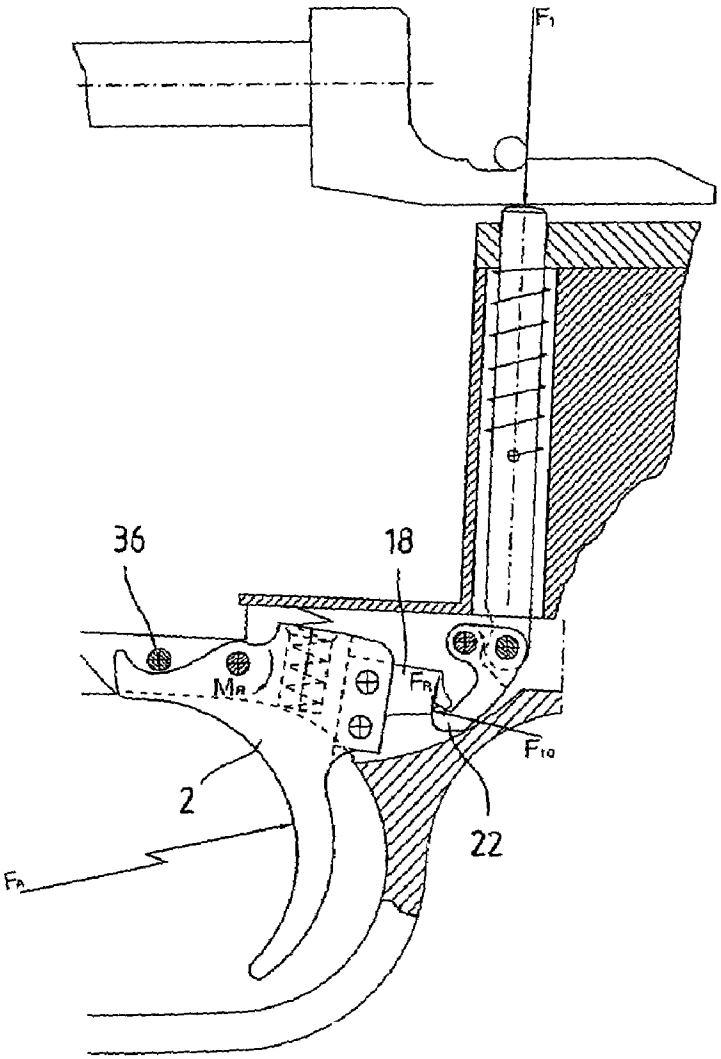
Figure 5:
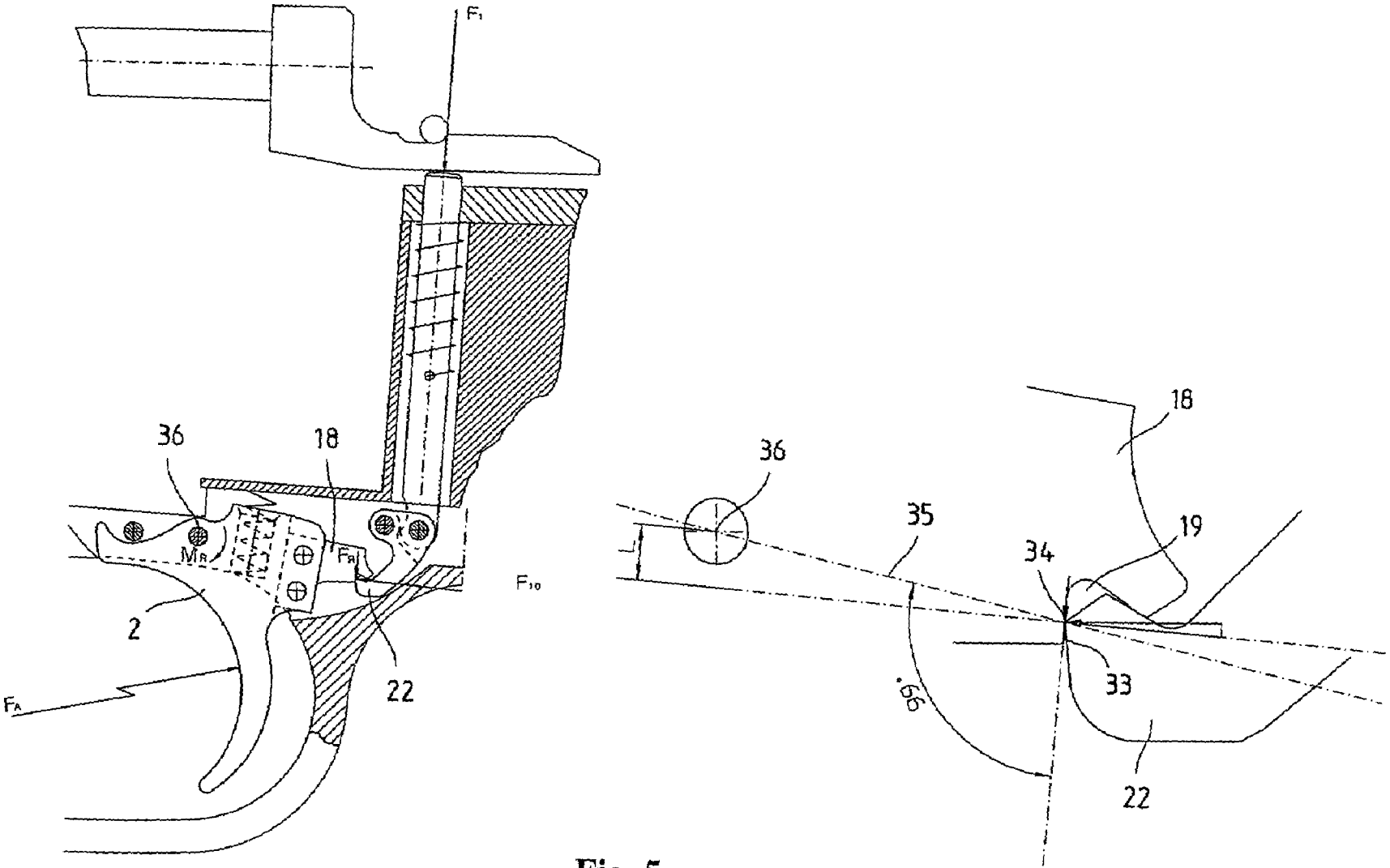

In the above-described firing mechanism, the trigger weight can be adjusted quite easily without having to change the spring characteristic, namely by varying the contact ratios between the latching groove 19 and the catch 22. According to the enlarged representations shown in FIGS. 4 and 5, the latching groove 19 has an oblique contact surface 33 that is contacted by a front edge 34 of the catch 22. FIGS. 4 and 5 show two different trigger variations that have different respective trigger weights. In the cocked position, a downwardly directed compressive force $F_1$ acts upon the trigger rod 4 in both variations, with the value of said compressive force being defined by the elasticity of the not-shown main spring and the contact between the cocking piece 8 and the transverse pin 10 at the depression 11. The articulated lever 3 subjects the rear latch part 18 of the trigger 2 to a force comprising a component $F_{10}$ acting normal to the contact surface 33 and a component $F_R$ acting perpendicular thereto. The intensity of the component $F_{10}$ and its direction are defined by the angle of inclination of the contact surface 33. The angle of inclination is defined as the angle $\alpha$ between the contact surface 33 and a straight line 35 that connects the pivot axis 36 of the trigger and the contact point between the edge 34 of the catch and the contact surface 33.

In the variation shown in FIG. 4, the oblique contact surface 33 is inclined relative to the straight connecting line 35 by an angle of 90°. Consequently, the component $F_{10}$ extends through the pivot axis 36. If the compressive force $F_1$ defined by the main spring amounts to 90 N, the force $F_A$ required for overcoming the resistance of the trigger 2, and thus for its actuation, is 6.5 N in this variation.

In the variation shown in FIG. 5, the angle of inclination of the oblique contact surface 33 relative to the straight connecting line 35 is 99°. This means that the component $F_{10}$ is greater in this variation than in the variation according to FIG. 4. In addition, the component $F_{10}$ no longer extends through the pivot axis 36, but rather exerts a torque about the pivot axis 36, opposite to the firing direction of the trigger 2, by means of a lever arm L. In this variation, the force required for overcoming the resistance of the trigger 2, and thus for its actuation, amounts to $F_A$=15 N.

The force required to actuate the firing mechanism can be adjusted by changing the angle of inclination of the oblique contact surface 33. In this context, it would be conceivable to make available different triggers 2 and/or latch parts 18 that can be easily interchanged.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A firing mechanism for a small arm comprising:

a housing;

a trigger pivotably positioned in the housing about a trigger axis and including a latch having a lower latching groove and a lower control surface positioned in front of the latching groove;

a trigger rod displaceably positioned within the housing and including a first end for retaining and releasing a biased firing pin; and an articulated lever pivotably connected to a second end of the trigger rod, and including an upwardly projecting catch that is engagable in the lower latching groove in the latch of the trigger in a cocked position, wherein the lower latching groove includes an oblique contact surface engagable by a front edge of the upwardly projecting catch, wherein the upwardly projecting catch comes into contact with the lower control surface of the trigger when the trigger is actuated; and wherein a resistance of the trigger can be adjusted by changing an angle of inclination of the oblique contact surface.

2. The firing mechanism according to claim 1, wherein the lower latching groove and the lower control surface are arranged on a rear latch part of the trigger.

3. The firing mechanism according to claim 2, wherein the rear latch part is removably connected to the trigger.

4. The firing mechanism according to claim 3, wherein the rear latch part is positioned in a channel on a rear side of a trigger plate of the trigger.

5. The firing mechanism according to one of claim 1, wherein the trigger includes a set screw that is arranged in a height-adjustable fashion within a threaded bore, and includes a trigger spring resting on a head of the set screw.

6. The firing mechanism according to one of claim 1, wherein the upwardly projecting catch is pressed against the latch of the trigger by a compression spring.

7. A firing mechanism for a small arm comprising:

a housing;

a trigger pivotably positioned in the housing about a trigger axis and including a latch having rear latch pan removably connected to the trigger, the rear latch part including a lower latching groove and a lower control surface positioned in front of the latching groove;

a trigger rod displaceably positioned within the housing and including a first end for retaining and releasing a biased firing pin; and an articulated lever pivotably connected to a second end of the trigger rod, and including an upwardly projecting catch that is engagable in the lower latching groove in a cocked position, wherein the lower latching groove includes an oblique contact surface engagable by a front edge of the upwardly projecting catch, and wherein the upwardly projecting catch comes into contact with the lower control surface when the trigger is actuated.

* * * * *